United States Patent [19]

Hetzer et al.

[11] Patent Number: 4,614,163

[45] Date of Patent: Sep. 30, 1986

[54] INK POT FOR FELT PENS FOR INSCRIBING POSTERS OR THE LIKE

[75] Inventors: Nobert Hetzer, Lobbach; Wolfgang Sommerfeld, Sinsheim-Hoffenheim, both of Fed. Rep. of Germany

[73] Assignee: Esselte Pendaflex Corporation, Garden City, N.Y.

[21] Appl. No.: 643,519

[22] Filed: Aug. 23, 1984

[30] Foreign Application Priority Data

Sep. 8, 1983 [DE] Fed. Rep. of Germany ..... 3332466

[51] Int. Cl.[4] ..... B05C 1/02

[52] U.S. Cl. ..... 118/268; 118/269

[58] Field of Search ..... 118/268, 264, 269

[56] References Cited

U.S. PATENT DOCUMENTS

| | | | |
|---|---|---|---|
| 425,834 | 4/1890 | Sword | 118/268 |
| 733,491 | 7/1903 | Litchfield | 118/268 |
| 2,620,499 | 12/1952 | Dressel | 118/268 X |
| 4,058,085 | 11/1977 | Yang | 118/264 |

FOREIGN PATENT DOCUMENTS

| | | | |
|---|---|---|---|
| 922732 | 4/1963 | United Kingdom | 118/264 |

*Primary Examiner*—John P. McIntosh

*Attorney, Agent, or Firm*—Gerald J. Ferguson, Jr.; James E. Bryan; Michael P. Hoffman

[57] ABSTRACT

An ink pot for felt pens for inscribing posters or the like is described which comprises an ink container (3) and a cover (4) in which openings (5, 6, 7) are disposed for receiving felt pens (8, 9, 10). In the ink container (3) a suction funnel (20) is accommodated which comprises a funnel cone (21) in contact with its outer edge (23) with the inner wall of container (3) and a suction tube (22) which adjoins the funnel cone (21), projects towards the container bottom and terminates just above the latter. In the funnel cone (21) and in the suction tube (22) a suction body (25) is disposed and over the funnel cone (21) there is an ink pad (26) which is in contact with the suction body (25). The suction funnel (20) and the ink pad (26) are fixedly anchored in the ink container (3).

12 Claims, 4 Drawing Figures

INK POT FOR FELT PENS FOR INSCRIBING POSTERS OR THE LIKE

Figure 1:
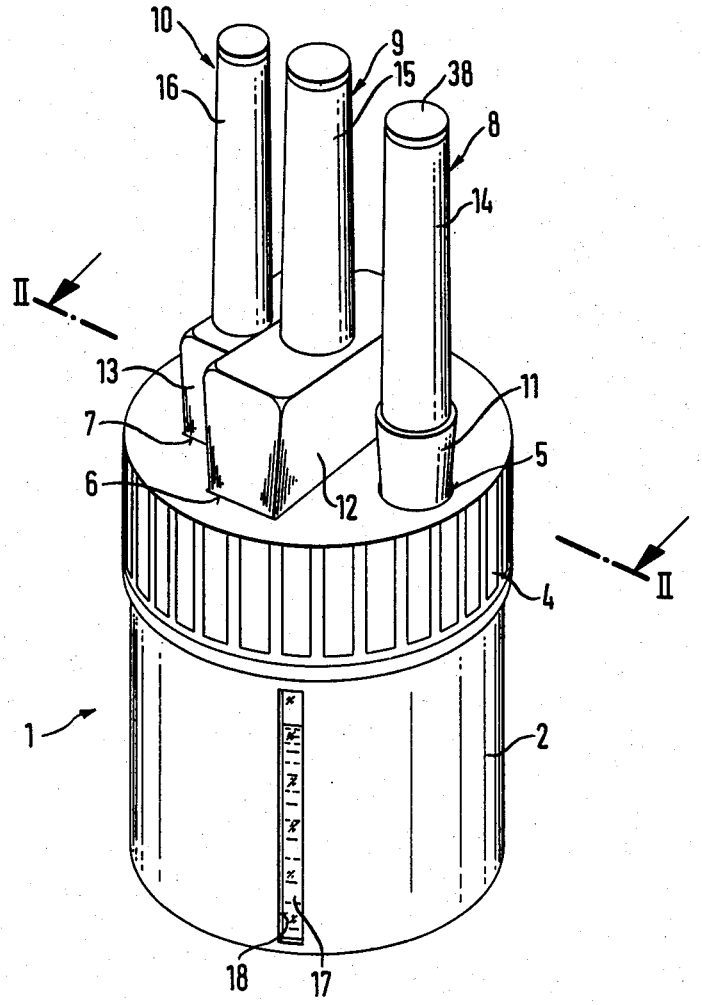

The invention relates to an ink pot for felt pens for inscribing posters or the like, comprising an ink container and a cover in which openings are provided for receiving felt pens.

In an ink pot known from DE-OS 2,907,531 the ink container is almost completely filled by an ink pad which consists of felt and which must always be kept well impregnated with ink. With this ink pot, when not in use the felt pens are inserted into the openings in the cover and project into the interior of the ink pot to such an extent that with the felt disposed in their writing head they are in contact with the ink impregnated ink pad. In this manner, when the felt pen is not in use the writing felt can become fully saturated with ink by contact with the ink pad so that the felt pen is always kept ready for use. Since in the known ink pot the interior of the ink container is almost completely filled by the ink pad consisting of felt the ink holding capacity is limited and consequently ink must frequently be replenished. For replenishment, firstly the felt pens must be removed from the cover openings, the cover then opened, whereupon finally the ink can be poured from a separate supply container onto the ink pad. To avoid too frequent replenishment the user is tempted to pour as much ink as possible onto the ink pad which frequently leads to more ink being introduced than can be absorbed by the ink pad. If such an ink container which has just been replenished is unintentionally knocked over the ink can immediately flow out of the openings in the cover and this can lead to extremely unpleasant soiling which is very difficult and sometimes even impossible to remove. The known ink pot is thus not completely satisfactory both as regards the ink holding capacity and as regards its handling.

The problem underlying the invention is to provide an ink pot which with high ink holding capacity is distinguished by simple handling with no danger of soiling by spilt ink.

According to the invention this problem is solved in that in the ink container a suction funnel is disposed comprising a funnel cone which is in contact at its outer edge with the inner wall of the ink container and a suction tube which adjoins the funnel cone, projects towards the container bottom and terminates just above the latter, that in the funnel cone and the suction tube a suction body is disposed, that over the funnel cone an ink pad in contact with the suction body is disposed, and that the suction funnel and the ink pad are fixedly anchored in the ink container.

In the ink pot according to the invention the suction funnel disposed in the ink container provides a free space which can be filled with ink. The supply of the ink from this space to the ink pad is through the suction body which is disposed in the suction funnel and which keeps the ink pad, with which the writing felts of the felt pens are in contact when not in use, permanently impregnated with ink. Since the ink container is no longer almost completely filled by the ink pad its ink holding capacity is high. In spite of the presence of the relatively great amount of ink in the ink container running out of the ink is prevented with relatively high certainty because the ink is now conveyed from the suction body to the suction pad on the basis of the capillary action which means that the liquid ink not stored in a fibrous material cannot run out of the ink container when the latter falls over. When the ink supply in the ink container is used up the entire ink container with the suction funnel, the suction body and the ink pad is replaced as a unit by a new filled ink container so that the troublesome replenishment of ink is superfluous. This very considerably reduces the danger of soiling.

Advantageous further developments of the invention are characterized in the subsidiary claims.

Figure 2:
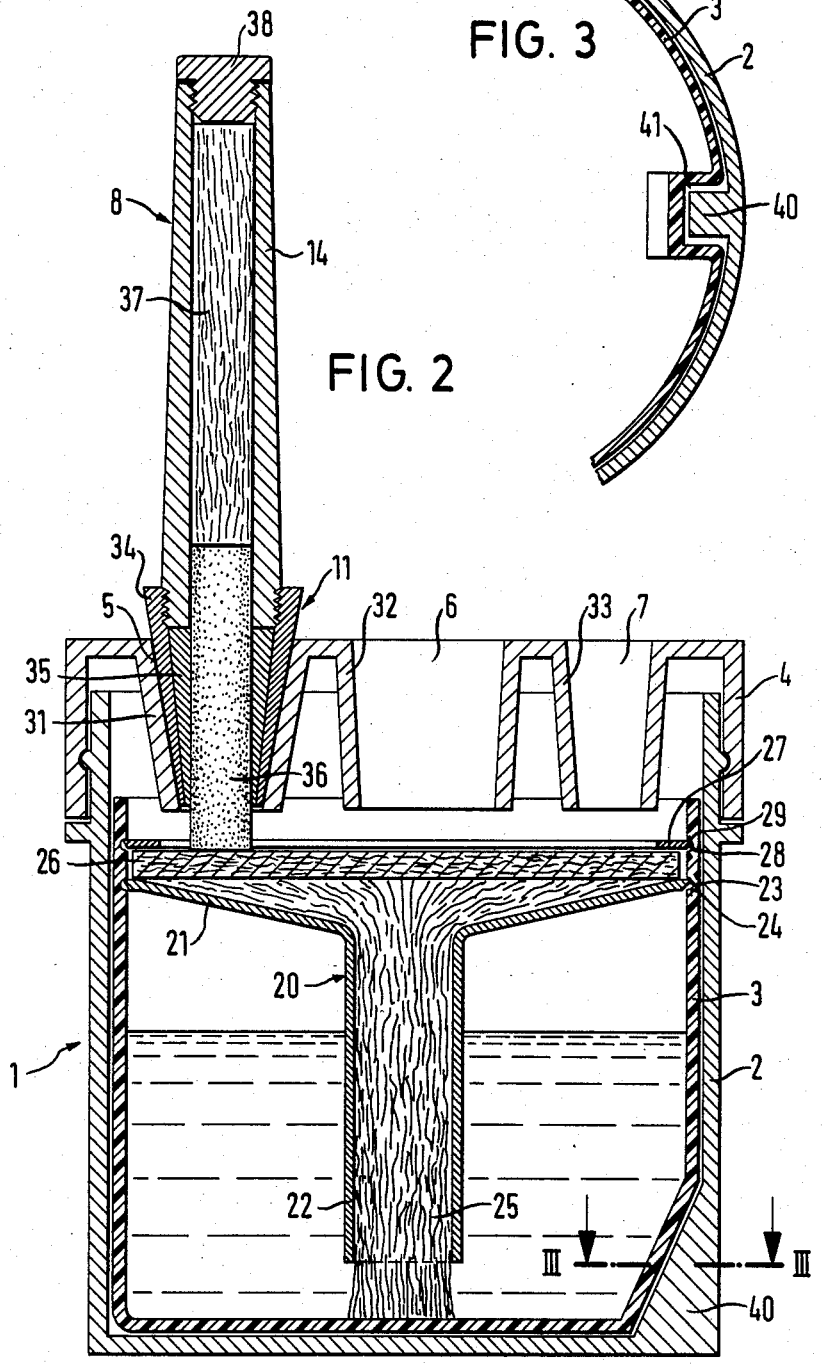
Figure 3:
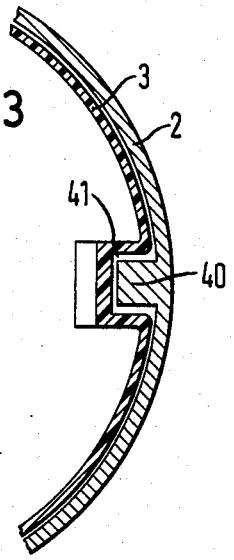
Figure 4:
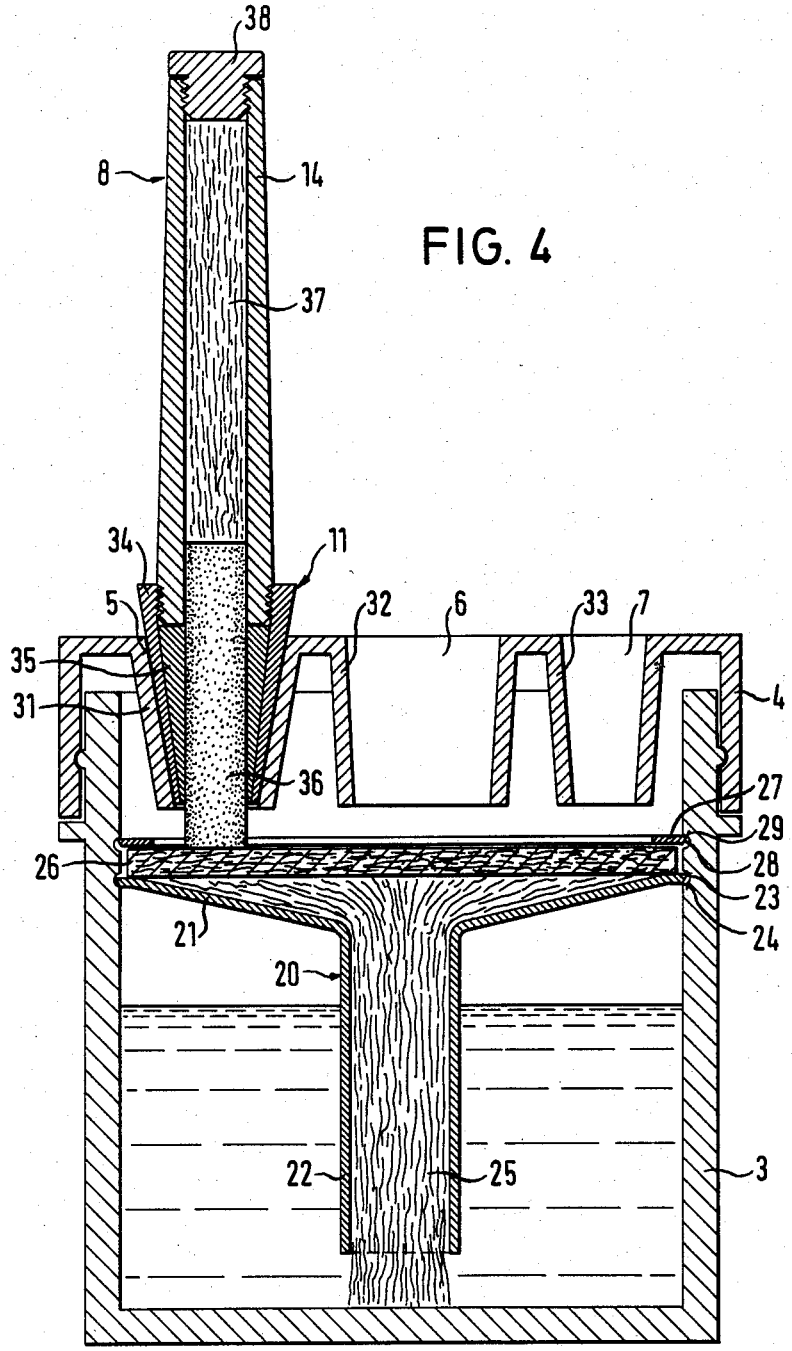

Examples of embodiment of the invention will now be explained with reference to the drawings, wherein:

FIG. 1 is a perspective view of an ink pot according to the invention with three felt pens inserted in openings in the cover, FIG. 2 is a section along the line II—II of FIG. 1, and for simplification of the illustration only one of the felt pens is shown inserted in the cover of the ink pot, FIG. 3 is a section along the line III—III of FIG. 2, and FIG. 4 is a section corresponding to the section of FIG. 2 through a second embodiment of the ink pot according to the invention.

The ink pot 1 illustrated in FIG. 1 includes a housing 2 in which the ink container 3 shown only in FIG. 2 is inserted. Formed in a cover 4 connected to the housing 2 are openings 5, 6, 7 into which felt pens 8, 9 and 10 respectively are inserted. The felt pens each have a writing head 11, 12, 13 and a stem 14, 15, 16. The writing heads 11, 12, 13 are differently formed to receive different-sized writing felts making the inscribing of posters with differently wide characters possible. The exact makeup of a felt pen will be explained in detail with the aid of FIG. 2 for the felt pen 8.

Disposed in the wall of the ink container 3 is an inspection window 17 and in the wall of the housing 2 there is a slot 18 whose dimensions correspond to those of the inspection window. It is possible through the slot 18 and the inspection window 17 to see the ink level in the ink container.

In the sectional view of FIG. 2 the details of the construction of the ink pot of FIG. 1 are shown. The ink container 3 inserted into the housing 2 contains a suction funnel 20 with a funnel cone 21 and a suction tube 22. The outer edge 23 of the funnel cone 21 is in contact with the inner wall of the ink container 3; it engages into a groove 24 disposed in the inner wall of the ink container 3. The ink container is made from a plastic material which is slightly elastically deformable; this enables the suction funnel consisting of rigid material to be pressed easily from above into the ink container until the outer edge of the suction funnel 20 engages into the groove 24. The suction funnel 20 is thereby reliably secured in the ink container 3. The interior of the suction funnel 20 is filled with a suction body 25 which consists of a nonwoven or fleece material made up predominantly of longitudinal fibers. The fibers of the suction body are preferably polyester fibers.

Disposed above the funnel cone 21 of the suction funnel 20 is an ink pad 26 which is in contact with the suction body 25. The ink pad 26 consists of a felt material. For anchoring the ink pad 26 in the ink container 3 a holder ring 27 is used which is disposed on the ink pad 26 in such a manner that its outer edge 28 engages into a groove 29 in the wall of the ink container 3. The groove 29 is disposed a distance above the groove 24 corresponding to the thickness of the ink pad 26. Because of the deformability of the ink container 3 no difficulties are encountered in fitting the holder ring 27 in the container 3. The holder ring 27 may also be connected at the edge integrally to the funnel cone edge and the groove 29 can then be omitted.

The space beneath the suction funnel 20 in the unused condition of the ink container 3 is almost completely full with ink. The suction body 25 conveys the ink by capillary action upwardly to the ink pad 26 so that the latter is kept permanently saturated with ink. By the ink pad 26 and the holder ring 27 the ink container 3 is completely sealed so that no ink can run out when the container is unintentionally knocked over. Although the ink pad 26 is permanently soaked with ink even when the ink container 3 is held with the ink pad at the bottom it takes a relatively long time for the ink pad 26 to be saturated with ink to such an extent that drops detach themselves therefrom. A direct spilling of the ink is not possible under any circumstances.

FIG. 2 also shows the construction of the felt pen 8. This felt pen 8 is inserted into the opening 5 in the cover 4. For reliable holding an inwardly projecting guide bush 31 is disposed at the opening 5. This guide bush 31 is also conical to match the conically formed writing head 11. At the openings 6 and 7 in the cover 4 guide bushes 32 and 33 respectively are also provided which serve to receive the writing heads 12 and 13 respectively. The conical form of the writing heads and the guide bushes has the advantage that the felt pens do not fall through the openings when the cover 4 is removed from the housing 2 but can be lifted from the housing 2 together with said cover 4.

The writing head 11 of the felt pen 8 consists of a grip piece 34, a clamp sleeve 35 and a writing felt 36. The grip piece 34 has a conical outer form. The inner surface of the grip piece 34 also extends conically and is contact with the conical outer surface of the clamp sleeve 35. The stem 14 of the felt pen 8 is made tubular and contains a storage body 37 of absorbent nonwoven or fleece material. Screwed into the end of the stem 14 remote from the writing head is a stopper 38.

The stem 14 is screwed to the grip piece 34 and as apparent from FIG. 2 in the firmly screwed state the writing felt 36 projects into the stem 14 to such an extent that it is in contact with the storage body 37. The stem 14 is so dimensioned that screwing into the grip piece 34 it presses against the clamp sleeve 35 which due to the conical form of the clamp sleeve 35 and of the inner surface of the grip piece 34 leads to the writing felt 36 being reliably clamped in the writing head 11.

The writing felt 36 is in contact with the ink pad 26 when the felt pen 8 is inserted into the opening 5. In this manner it is ensured that the writing felt 36 of the felt pen 8 is always saturated with ink. The writing felt 36 conveys the ink supplied thereto by the ink pad 26 to the storage body 37 which is thereby also saturated with ink. The felt pen 8 can therefore be used for a relatively long time before having to again supply ink thereto from the ink pad 26. When the writing tip of the writing felt 36 is worn the writing head 11 is unscrewed from the stem 14 and a new writing head is inserted; it is not necessary to touch the writing felt 36 when this is done and consequently the user's fingers do not become soiled with ink. The storage body 37 remains in the stem 14 so that the new writing felt 36 is again rapidly saturated with ink until a state suitable for writing is reached.

The cover 4 can for example be connected by screwing to the housing 2. Preferably, however, it is connected to the housing 2 by means of bayonet connection because this makes the closing and opening operation quicker. Also, the production of the grooves and projections for a bayonet connection is simpler than the production of a screw thread with several turns.

As was explained in conjunction with FIG. 1 in the ink container 3 an inspection window 17 is provided and in the housing 2 a slot 18 to enable the ink level to be checked at any time. The ink container 3 must however assume a position in the housing 2 such that the inspection window 17 coincides exactly with the slot. To ensure that the ink container always assumes this predetermined position in the housing 2 a web 40 is disposed at the wall of the housing 2 and the wall of the ink container 3 comprises a corresponding groove 41 whose width and form corresponds to the width and form of the web 40. Because of the presence of the web 40 the ink container 3 can be inserted correctly into the housing 2 only if the groove 41 accommodates the web 40. In this manner it is ensured that the ink container 3 always assumes a predetermined position in the housing 2. FIG. 3 shows in sectional view the cooperation of the web 40 and the groove 41.

If the ink material 3 consists of a material through which the ink level is visible without providing a special inspection window it will of course suffice simply to provide the slot 18 in the wall of the housing 10 to permit a constant check on the level.

FIG. 4 illustrates a further example of embodiment of an ink pot. In this example of embodiment the ink container 3 is not accommodated in a separate housing 2 on which the cover 4 is secured. On the contrary, in this example of embodiment the cover 4 is directly connected to the ink container 3. When with an ink pot according to this example of embodiment the ink supply in the ink container 3 is exhausted the cover 4 is removed and placed on a new full ink container 3. Apart from this difference the ink pot of FIG. 4 corresponds to the ink pot illustrated in FIG. 2 and consequently a further description would be superfluous.

Since when inscribing or painting posters several colors are usually employed the user requires simultaneously several pots and corresponding felt pens for the respective colors. To avoid for example a felt pen whose writing felt is impregnated with black ink being mistakenly introduced into the associated opening in the cover of an ink pot filled with red ink, the cover and the stopper 38 on the associated felt pen can be made in a color corresponding to the ink color. It makes it easy to tell the various colors apart and the proper association of the felt pen to the associated ink pot is considerably facilitated.

In the unused condition the ink container 3 is hermetically sealed with a sealing foil whose edge is adhered to the upper edge of the container wall. Prior to introduction of the container 3 into the housing 2 (in the embodiment of FIG. 2) or prior to the screwing on of the cover 4 (in the embodiment of FIG. 4) the sealing foil is stripped off so that the ink pad 26 can be contacted by the writing felts of the felt pens.

We claim:

1. Ink pot for felt pens for inscribing posters or the like, comprising an ink container and a cover in which openings are provided for receiving felt pens, characterized in that in the ink container (3) a suction funnel (20) is disposed comprising a funnel cone (21) which is in contact at its outer edge (23) with the inner wall of the ink container (3) and a suction tube (22) which adjoins the funnel cone (21), projects towards the container bottom and terminates just above the latter, that in the funnel cone (21) and in the suction tube (22) a suction body (25) is disposed, that over the funnel cone (21) an ink pad (26) in contact with the suction body (25) is disposed, and that the suction funnel (20) and the ink pad (26) are fixedly anchored in the ink container (3).

2. Ink pot according to claim 1, characterized in that the suction body (25) consists of a nonwoven or fleece material consisting predominantly of longitudinal fibers.

3. Ink pot according to claim 1 or 2, characterized in that the ink pad (26) is a felt disc whose diameter corresponds to the internal diameter of the ink container (3).

4. Ink pot according to claim 1 characterized in that the ink container (3) is surrounded by a housing (2) which is connected to the cover (4).

5. Ink pot according to claim 4, characterized in that in the wall of the ink container (3) extending in the axial direction thereof an inspection window (17) is disposed through which the ink level can be seen, and that in the wall of the housing (2) a slot (18) is disposed whose dimensions correspond to those of the inspection window (17).

6. Ink pot according to claim 5, characterized in that at the inner wall of the housing (2) an inwardly projecting web (40) extending in the axial direction is disposed and that in the wall of the ink container (3) a groove (41) is formed which is so dimensioned that it accommodates the web (40) at the housing wall when the ink container (3) is in the housing (2).

7. Ink pot according to claim 1, characterized in that the ink container (3) is directly connected to the cover (4).

8. Ink pot according to claim 5, characterized in that in the wall of the ink container (3) an inspection window (17) extending in the axial direction thereof is disposed through which the ink level can be seen.

9. Ink pot according to claim 1 characterized in that on the ink pad (26) a holding ring (27) rests whose outer edge (28) engages in a groove (29) in the inner wall of the ink container.

10. Ink pot according to claim 9, characterized in that the outer edge (23) of the funnel cone (21) engages in a groove (24) which is disposed at a distance corresponding to the thickness of the ink pad (26) from the groove (29) provided for the holding ring (27) in the inner wall of the ink container (3).

11. Ink pot according to claim 1, characterized in that the outer edge (23) of the funnel cone (21) engages into a groove (24) which is disposed in the inner wall of the ink container (3) and that on the ink pad (26) a holding ring (27) rests which at the edge is integrally connected to the funnel cone edge.

12. Ink pot according to claim 1 characterized in that on the inner side of the cover (4) at the openings (5, 6, 7) thereof inwardly projecting guide bushes (31, 32, 33) are provided which have conical inner surfaces for receiving conical writing heads (11, 12, 13) of the felt pens (8, 9, 10).

* * * * *